US007497701B2

(12) United States Patent
Zhu et al.

(10) Patent No.: US 7,497,701 B2
(45) Date of Patent: Mar. 3, 2009

(54) ELECTRICAL CONNECTOR WITH IMPROVED HOUSING

(75) Inventors: Yu Zhu, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,464

(22) Filed: Jan. 18, 2008

(65) Prior Publication Data

US 2008/0176426 A1 Jul. 24, 2008

(30) Foreign Application Priority Data

Jan. 19, 2007 (CN) ..... 2007 2 0033657 U

(51) Int. Cl.
*H01R 24/00* (2006.01)

(52) U.S. Cl. ..... 439/79

(58) Field of Classification Search ..... 439/682, 439/567, 374, 680, 569, 660, 444, 941, 79
See application file for complete search history.

(56) References Cited

U.S. PATENT DOCUMENTS 5,658,154 A * 8/1997 Bumsted et al. ..... 439/79
6,648,682 B1 * 11/2003 Wu ..... 439/567
6,712,632 B2 * 3/2004 Wu ..... 439/328
6,790,053 B2 9/2004 Lin et al.

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector comprises an elongated insulative housing and a plurality of terminals. The elongated insulative housing defines a mating face, a rear end face opposite to the mating face and a plurality of receiving passageways extending through the mating face and the rear end face, and said insulative housing defines a plurality of retention means and a support means extending horizontally away from the rear end face respectively. The plurality of terminals are assembled to the receiving passageways, and each terminal comprises a tail portion extending away from the rear end face. The support means is below the tail portions of the terminals.

10 Claims, 3 Drawing Sheets

ELECTRICAL CONNECTOR WITH IMPROVED HOUSING

BACKGROUND OF THE INVENTION

1. Field of the Invention

The present invention relates to an electrical connector, and particularly to an electrical connector for mounting on a circuit board.

2. Description of the Prior Art

An electrical connector is usually required to establish a electrical connection between a complementary connector and a printed circuit board. Such connectors are of many forms configured to compliant to different applications. More particularly, many electrical connectors having molded plastic housings which are considerable elongated. Most often, problems continue to be encountered.

Please refer to U.S. Pat. No. 6,790,053 invented by Lin et al., Lin et al. discloses an electrical connector for mounting on a circuit board, comprising an elongated insulative housing and a plurality of terminals disposed therein. The insulative housing comprises a base portion, three mating ports extending forwardly from the base portion and a plurality of retention portions extending backwardly from the base portion for retaining a circuit board. However, the retention portions should be disposed at appropriated location according the electrical connector. The distance between the retention portions is inevitable to be increased. When the plurality of terminals are soldered to the circuit board, high temperature will result in the warpage or distortion of the circuit board, and a reliable electrical connection will be affected accordingly.

Hence, an improved electrical connector is desired to overcome the disadvantages of the prior art.

BRIEF SUMMARY OF THE INVENTION

Therefore, a main object of the present invention is to provide an electrical connector for establishing a reliable electrical connection with a circuit board.

To fulfill the above-mentioned object, an electrical connector according to the present invention comprises an elongated insulative housing and a plurality of terminals. The elongated insulative housing defines a mating face, a rear end face opposite to the mating face and a plurality of receiving passageways extending through the mating face and the rear end face, and said insulative housing defines a plurality of retention means and a support means extending horizontally away from the rear end face respectively. The plurality of terminals are assembled to the receiving passageways, and each terminal comprises a tail portion extending away from the rear end face. The support means is below the tail portions of the terminals.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
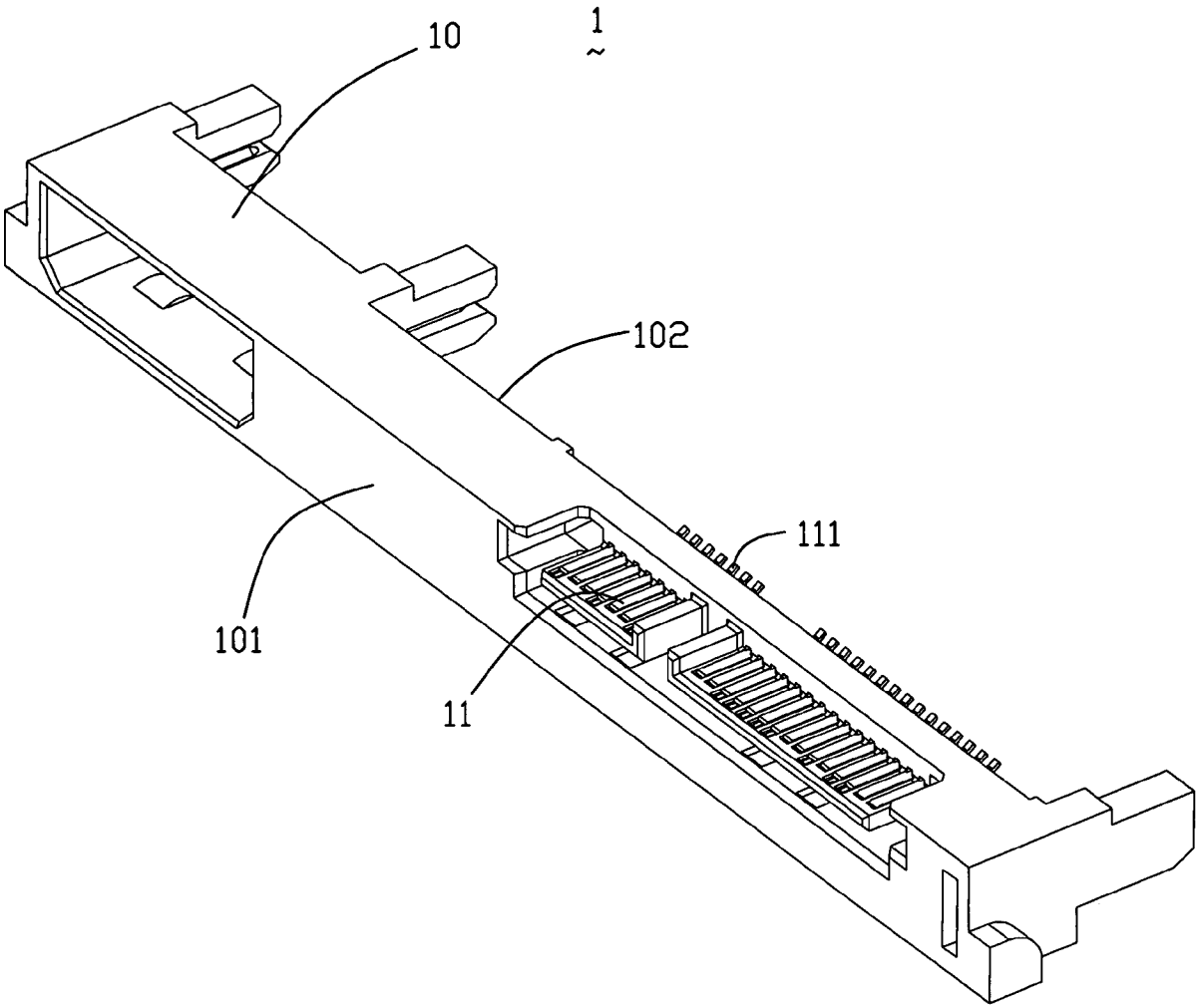
FIG. 1 is an assembled, perspective view of an electrical connector according to the present invention.
Figure 2:
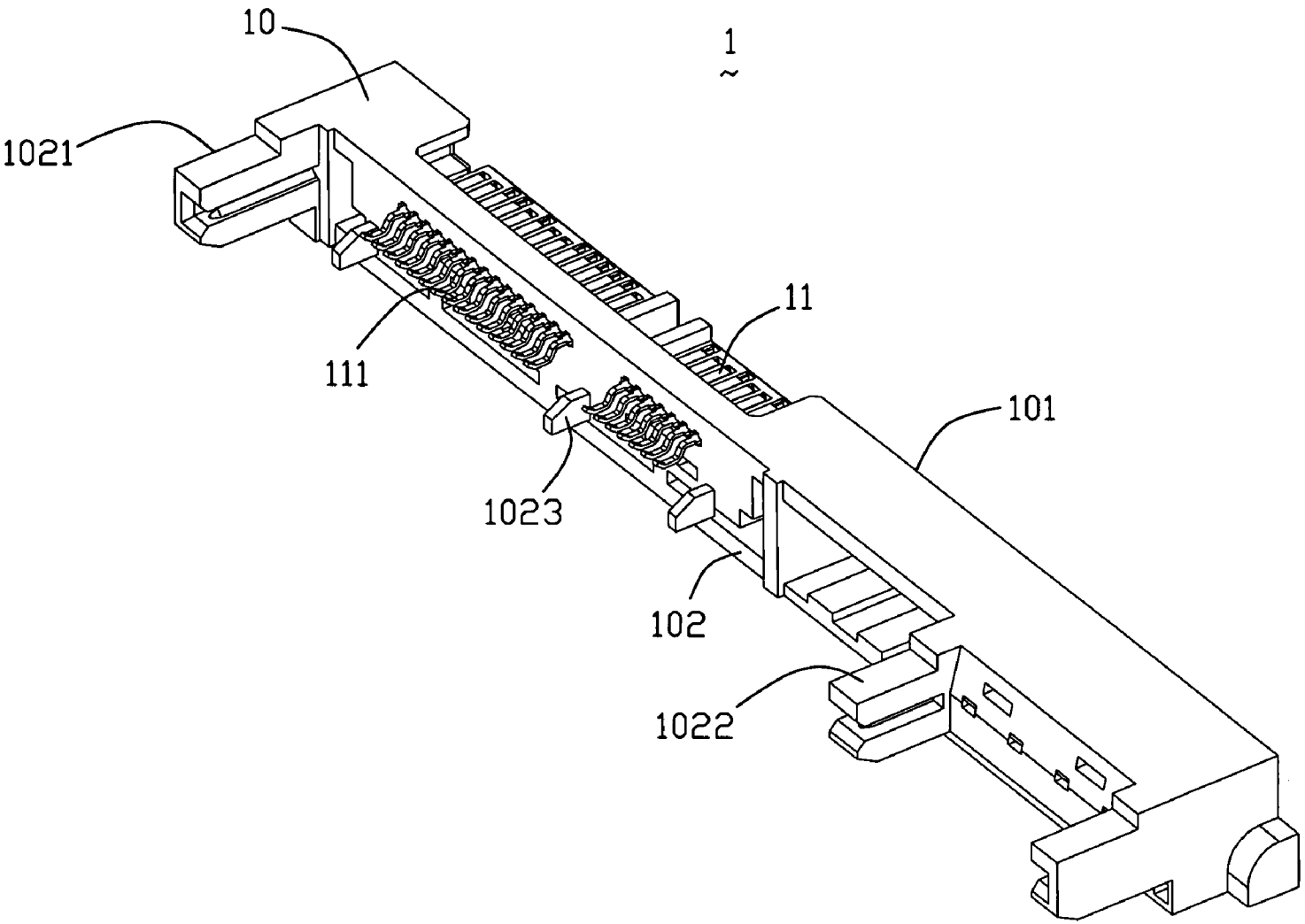
FIG. 2 is a view similar to FIG. 1, but viewed from another aspect.
Figure 3:
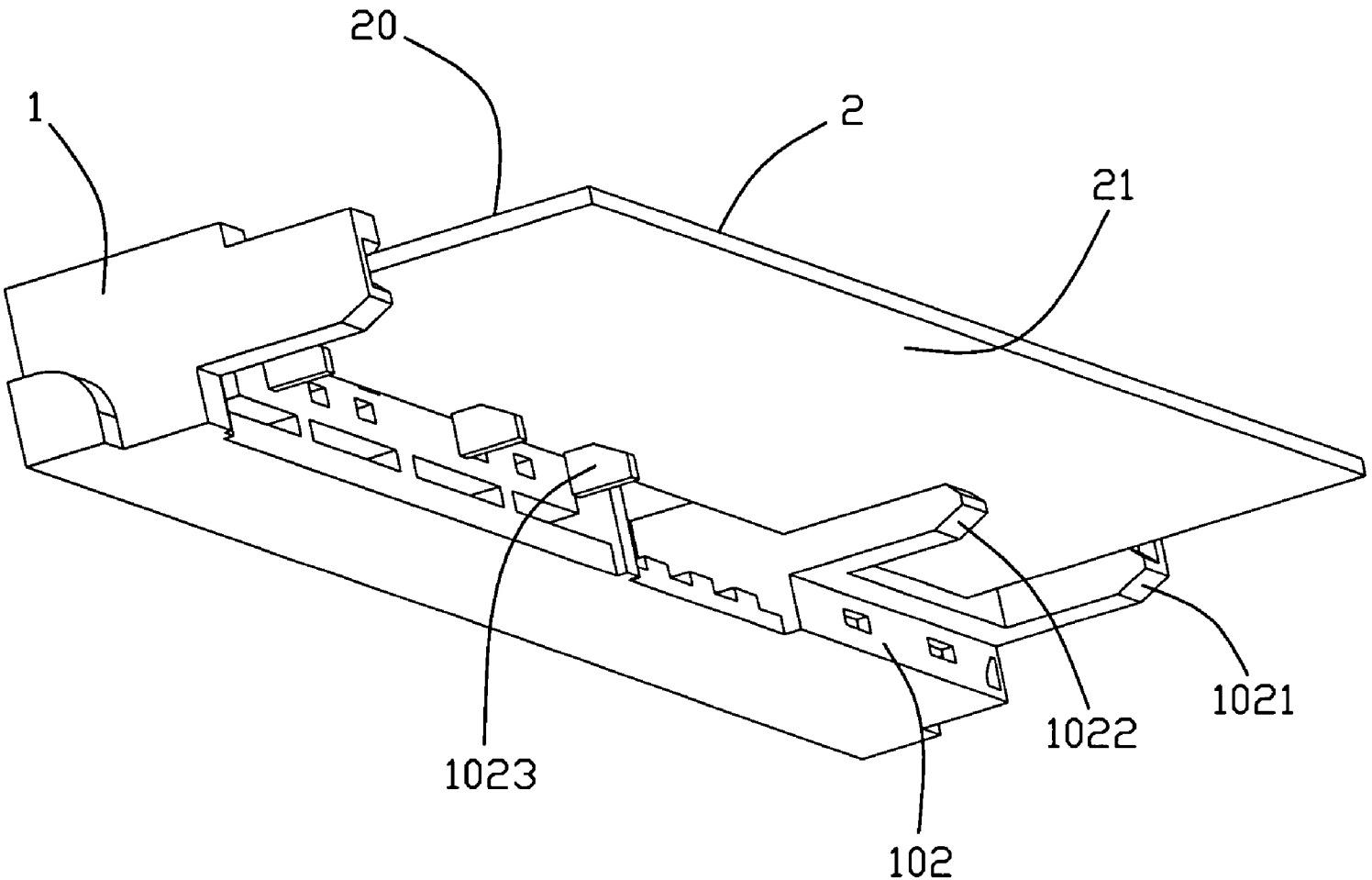
FIG. 3 shows the electrical connector according to the present invention assembled with a circuit board.

Referring to FIGS. 1-3, an electrical connector 1 according to the present invention is adapted for mounting on a circuit board 2 and connecting a complementary connector (not shown). The electrical connector 1 comprises an insulative housing 10 and a plurality of terminals 11 disposed therein. The circuit board 2 defines an upper surface 20, a bottom surface 21 and a plurality of conductive elements (not shown) located at the upper surface 20.

The insulative housing 10 is substantially elongated and integrally formed, and comprises a mating face 101 for engaging with a complementary connector, a rear end face 102 opposite to the mating face 101 and a plurality of receiving passageways (not labeled) extending through the mating face 101 and the rear end face 102 for receiving the plurality of terminals 11. Each terminal 11 defines a tail portion 111 extending outwardly from the rear end face 102 for surface mounting on the circuit board 2 and electrically connecting with the conductive elements.

The insulative housing 10 defines a plurality of retention means extending backwardly from the rear end face 102 thereof and a supporting means. The plurality of retention means comprise a pair of first retention portions 1021 disposed at two lateral sides of the insulative housing 10 and a second retention portion 1022 located between the pair of first retention portions 1021. Each of the first and second retention portions 1021, 1022 defines a receiving slot (not labeled). The receiving slots of the first retention portions 1021 are of transversal U-shape and opposite to each other for securely receiving the circuit board 2 to avoid the transversal movement of the circuit board. The receiving slots of the first and second retention portions are approximate coplanar with the tail portions 111 of the terminals 11. When the circuit board 2 is inserted into the receiving slots of the first and second retention portions 1021, 1022, the tail portions of the terminals 11 are corresponding to the conductive elements of the circuit board 2.

In the preferred embodiment, the support means are a plurality of discontinuous support boards 1023 extending outwardly form the rear end face 102 and locating between the plurality of retention means. Each support board 1023 defines an inclined surface at corner adjacent to the tail portions 111 of the terminals 11 for facilitating the insertion of the circuit board 2. The support boards 1023 are lower than the plane in which the tail portions 111 locates, and the distance between the support boards 1023 and the tail portions 111 of the terminals 11 are about the thickness of the circuit board 2. When the circuit board 2 is inserted into the receiving slot of the first and second retention portions 1021, 1022, the plurality of the support boards 1023 just resist against the bottom face 21. Therefore, the circuit board 2 is free from being warped and distorted due to the generated high temperature when the tail portions 111 of the terminals 11 are soldered with the conductive elements of the circuit board 2. A reliable electrical connection is established accordingly. In an alternative embodiment, the support means is a continuous flange.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, for mounting on a circuit board and connecting a complementary connector, comprising:

an elongated molded plastic housing is substantially elongated and integrally formed and a plurality of receiving passageways extending through a mating face and a rear end face for receiving the plurality of terminals;

the circuit board defines an upper surface, a bottom surface and a plurality of conductive elements located at the upper surface;

a tail portion of each terminal extending outwardly from the rear end face for mounting on the conductive elements of the circuit board;

a plurality of retention portions extending backwardly from the rear end face; a pair of first retention portions disposed at two lateral sides of the insulative housing and a second retention portion located between the pair of first retention portions; each of the first and second retention portions defines a receiving slot; the receiving slots of the first retention portions are of transversal U-shape and opposite to each other for securely receiving the circuit board to avoid the transversal movement of the circuit board and approximate coplanar with the tail portions of the terminals;

a supporting means are a plurality of rigid discontinuous support boards extending horizontally outward from the rear end face and locating between the plurality of retention means; each support board defines an inclined surface at corner adjacent to the tail portions of the terminals for guiding the insertion of the circuit board; the support boards are lower than the plane in which the tail portions locates, and the distance between the support boards and the tail portions of the terminals are about the thickness of the circuit board; and when the circuit board is inserted into the receiving slot of the first and second retention portions, the plurality of the support boards just resist against the bottom face; the circuit board is free from being warped and distorted due to the generated high temperature when the tail portions of the terminals are soldered with the conductive elements of the circuit board; a reliable electrical connection is established;

wherein the support means is below the tail portions of the terminals.

2. The electrical connector as claimed in claim 1, wherein said retention portions extend rearwardly longer than said supporting portions.

3. The electrical connector as claimed in claim 1, wherein the plurality of terminals are soldered to the circuit board.

4. The electrical connector as claimed in claim 1, wherein the support means is an elongated flange projecting backwardly away from the rear end face.

5. The connector as claimed in claim 4, wherein the plurality of terminals are soldered to the circuit board.

6. The electrical connector as claimed in claim 4, wherein said retention portions extend rearwardly longer than said supporting portions.

7. The electrical connector as described in claim 6, wherein each retention portion defines a receiving slot therein approximate coplanar with the tail portions of the terminals.

8. An electrical connector, for mounting on a circuit board and connecting a complementary connector, comprising:

an elongated molded plastic housing is substantially elongated and integrally formed and a plurality of receiving passageways extending through a mating face and a rear end face for receiving the plurality of terminals;

the circuit board defines an upper surface, a bottom surface and a plurality of conductive elements located at the upper surface;

a tail portion of each terminal extending outwardly from the rear end face for mounting on the conductive elements of the circuit board;

a plurality of retention portions formed on the rear face, a pair of first retention portions disposed at two lateral sides of the insulative housing and a second retention portion located between the pair of first retention portions; each of the first and second retention portions defines a receiving slot; the receiving slots of the first retention portions are of transversal U-shape and opposite to each other for sandwiching a printed circuit board therebetween to avoid the transversal movement of the circuit board and approximate coplanar with the tail portions of the terminals;

a plurality of rigid supporting devices form on the rear face and being offset from mounting portions of the contacts in both longitudinal direction and transverse direction which are perpendicular to not only each other but also said front-to-back direction; and a plurality of rigid supporting devices locating between the plurality of retention portions; each support devices defines an inclined surface at corner adjacent to the tail portions of the terminals for guiding the insertion of the circuit board;

wherein the mounting portions of the contacts and said supporting devices commonly define a gap in the transverse direction for receiving therebetween a printed circuit board which is also adapted to be retained by said retention portions; when the circuit board is inserted into the receiving slot, the plurality of the support devices just resist against the bottom face; the circuit board is free from being warped and distorted due to the generated high temperature when the tail portions of the terminals are soldered with the conductive elements of the circuit board; a reliable electrical connection is established.

9. The connector as claimed in claim 8, wherein said retention portions extend rearwardly longer than said supporting portions.

10. The connector as claimed in claim 8, wherein said supporting portions are chamfered for easy assembling the printed circuit board thereto.

* * * * *